US006168465B1

(12) United States Patent
Hirota

(10) Patent No.: US 6,168,465 B1
(45) Date of Patent: Jan. 2, 2001

(54) TERMINAL STRUCTURE AND A UNIVERSAL LOW NOISE BLOCKDOWN CONVERTER USING THE SAME

(75) Inventor: Makoto Hirota, Kobe (JP)

(73) Assignee: Sharp Kabushiki Kaisha, Osaka (JP)

( * ) Notice: Under 35 U.S.C. 154(b), the term of this patent shall be extended for 0 days.

(21) Appl. No.: 08/967,321

(22) Filed: Oct. 29, 1997

Related U.S. Application Data

(63) Continuation of application No. 08/577,216, filed on Dec. 22, 1995, now abandoned.

(30) Foreign Application Priority Data

Mar. 7, 1995 (JP) ..... 7-046852
Nov. 28, 1995 (JP) ..... 7-309252

(51) Int. Cl.[7] ..... H01R 9/05

(52) U.S. Cl. ..... 439/579; 439/885; 439/944; 439/48; 174/59; 174/52.1

(58) Field of Search ..... 439/46–48, 50, 439/578–585, 675, 721–725, 944, 885, 590; 174/59, 52.1

(56) References Cited

U.S. PATENT DOCUMENTS

| | | | | |
|---|---|---|---|---|
| 3,027,534 | * | 3/1962 | Deakin | 439/46 |
| 3,128,138 | * | 4/1964 | Noschese | 439/579 |
| 3,170,745 | * | 2/1965 | Deakin | 439/48 |
| 3,243,760 | * | 3/1966 | Dupre et al. | 439/579 |
| 3,377,607 | * | 4/1968 | Deakin | 439/48 |
| 3,423,716 | * | 1/1969 | Deakin | 439/48 |
| 3,676,744 | * | 7/1972 | Pennypacker | 174/59 |
| 3,760,329 | * | 9/1973 | Stepan | 439/46 |
| 3,904,812 | * | 9/1975 | Daffron | 174/52.1 |
| 4,015,070 | * | 3/1977 | Theurer | 174/52.1 |
| 4,431,253 | | 2/1984 | Hochgesang et al. . | |
| 4,580,863 | | 4/1986 | Lohr et al. . | |
| 5,026,306 | | 6/1991 | Uekido et al. . | |
| 5,064,390 | * | 11/1991 | Umesato et al. | 439/721 |
| 5,219,297 | * | 6/1993 | Stein et al. | 439/944 |
| 5,233,501 | * | 8/1993 | Allen et al. | 439/944 |
| 5,348,491 | | 9/1994 | Louwagie et al. . | |

FOREIGN PATENT DOCUMENTS

| | | | | |
|---|---|---|---|---|
| 0276932 | | 8/1988 | (EP) . | |
| 1415894 | * | 12/1975 | (GB) | 439/885 |
| 49-25303 U | | 3/1974 | (JP) . | |
| 57-171281 | | 10/1982 | (JP) . | |
| 59-9657 U | | 1/1984 | (JP) . | |
| 61-156184 U | | 9/1986 | (JP) . | |
| 63-18894 U | | 2/1988 | (JP) . | |
| 3-152886 | | 6/1991 | (JP) . | |
| 451704 | | 2/1992 | (JP) . | |
| 5-17963 U | | 3/1993 | (JP) . | |
| 5-267903 | | 10/1993 | (JP) . | |
| 6-45779 | | 2/1994 | (JP) . | |
| 6-68338 U | | 9/1994 | (JP) . | |

* cited by examiner

*Primary Examiner*—Paula Bradley
*Assistant Examiner*—Tho D. Ta

(57) ABSTRACT

A terminal structure and a universal low noise blockdown converter having a multiple number of terminals for receiving a radio wave signal transmitted from satellites and converting it to an intermediate-frequency signal. The terminal structure includes: a terminal joint module having a multiple number of cylindrical outer conductors each having a core conductor inside the cylinder and a plate-like attachment base on which the cylindrical outer conductors are put together, wherein the outer conductors and the attachment base are integrally formed of an identical material or different materials. The universal low noise blockdown converter includes the above-described terminal structure in such an arrangement that the attachment base is fixed to one end face of the converter body.

6 Claims, 14 Drawing Sheets

TERMINAL STRUCTURE AND A UNIVERSAL LOW NOISE BLOCKDOWN CONVERTER USING THE SAME

This application is a continuation of application Ser. No. 08/577,216 filed on Dec. 22, 1995, now abandoned.

BACKGROUND OF THE INVENTION (1) Field of the Invention

The present invention relates to a universal low noise blockdown converter (LNB) which is known as a receiver-side converter for receiving a radio wave signal transmitted from broadcasting or communication satellites and converting it to a first intermediate-frequency signal in order to output the converted signal to a next step or a tuner circuit. More particularly, the present invention is directed to a terminal structure for output terminals to be used for various appliances inclusive of such converters.

(2) Description of the Prior Art

In recent years, there has been a world-wide trend of the rapid popularization of the satellite broadcasting to the general public. In harmony with this tendency, many proposals have been presented as to receiver-side converters which are to be used together with a satellite broadcasting receiving antenna. Examples of the latest receiver-side converters include various types such as LNBs (low noise blockdown converter) capable of receiving wide-band frequencies, LNBs for receiving both horizontally and vertically polarized waves, LNBs for receiving both right-handed and left-handed polarized waves. Any of these needs an increased number of terminals. These LNB converts for general use are called universal LNBs.

Now, let us consider the popularization tendency of satellite broadcasting in various countries and areas. In the European countries, the analog broadcasting via satellites, Astra (1A/1B/1C) had played a central role until recently. After Astra 1D was launched in 1994, the digital broadcasting was commenced experimentally, from January 1995. Satellite Astra 1E in October 1995 and satellite Astra 1F in the end of 1995 will be launched so as to establish the full-scale digital broadcasting market. Throughout Europe, there have been some 57 million subscribers, including both the direct receiving and indirect receiving subscribers, as of the end of 1994. Therefore, the market demands, by the commence of the digital broadcasting, the development of an LNB which has a broadened band range and is still highly stabilized so as to cover both the frequency bands.

In the American market, after the digital broadcasting was started on a full-scale from the middle of 1994, one million some hundred thousand subscribers have increased every year. Further, several programs of launching digital broadcasting satellites are scheduled by new companies. Accordingly, there is a strong demand of developing an LNB which has a broadened band range with a highly stabilized characteristic and is still inexpensive.

Turning to the Japanese market, digital broadcasting using the JCSAT is scheduled to start from the spring of 1996. In the first half of 1997, digital broadcasting using the Superbird is planned to commence. Thereby, there is an expectation that demand on an LNB which is able to receive both the digital satellite broadcasting and the digital broadcasting via CS will be increased.

Next, a typical receiver-side converter of this kind will be described with reference to drawings disclosed in Japanese Patent Application Laid-Open Hei 5 No.267,903.

FIG. 1 is a partially cutaway perspective view showing a typical receiver-side LNB converter used together with a BS antenna. As shown in FIG. 1, this configuration is composed of: a converter body 21; a circular waveguide 121 joined to a horn (a primary radiator) 120; a rectangular waveguide 122 which is integrally formed with the circular waveguide so as to extend perpendicular thereto; a base 123, typically made of tetra-fluoroethylene resin, attached so that the body is sandwiched at a predetermined position of the circular waveguide 121; a microstrip circuit board 124 formed on the surface of the base; an earthed surface 125 formed underside of the base 123 and constituting the upper surface of the rectangular waveguide; a first probe 126 projected from the inner surface of the circular waveguide 121 to detect horizontally polarized waves; and a second probe 127 projected from the inner surface of the rectangular waveguide 122 to detect vertically polarized waves.

In the LNB converter having the thus configuration as shown in FIG. 1, a matching reflection rib 128 for reflecting only the vertically polarized waves, by deflecting them 90° toward the second probe 127 is formed at the corner at which the circular waveguide 121 and the rectangular waveguide 122 are joined. The converter body 21 has a backside lid 129 so that the built-in microstrip circuit board 124 may be shielded from unnecessary radiation signals and the like. A terminal 22 which is connected to an unillustrated coaxial cable plug so as to allow the signal to output from the receiver-side LNB converter is fixed at one end of the converter body using a terminal base 119 with screws 24.

Designated at 130 is a short-circuited end surface for reflecting horizontally polarized waves. This will be described later.

As a terminal structure for the receiver-side converter of this kind, the following configuration has been known. FIG. 2A is a sectional side view partially showing the terminal structure of the conventional receiver-side converter and FIG. 2B is a bottom view of the same. This terminal structure includes a plurality of output terminals 22, each of which is securely attached by screws 24 to the converter body 21 with a hermetically sealing O-ring 23 therebetween. As shown in FIG. 3, each output terminal 22 is composed of a single unit in which an outer conductor 22*a* (to be called a shell, hereinbelow) of a metal with an assembly part 22*b* fixed therein by squeezing or press-fitting. This assembled part 22*b* is made of a laminate of a resin cap 25, a resin base 26 and a metallic contact 27.

FIGS. 4A and 4B show another example of a terminal structure of the conventional receiver-side converter. FIGS. 4A and 4B are partial sectional side view and bottom view, respectively. In this configuration, a plurality of output terminals 31 are screwed into corresponding, tapped holes 32 formed on the converter body 21 by machining process. A low cylindrical wall 33 projected from the outside surface of the converter is provided for each output terminal 21 and a hermetically sealing agent 34 is filled therein.

FIGS. 5A and 5B show a recently used configuration of a terminal structure in which a plurality of shells 22*a* for terminals 22, spaced at intervals of a center distance 1, are integrally formed with the converter body 21. FIGS. 5A and 5B are assembled and decomposed views, respectively. As seen in FIGS. 5A and 5B, an inner-terminal assembly part 22*b* is inserted into each shell 22*a* with an anti-falling press-ring 47 attached on the outer end. Outside peripheral of the shell 22*a* is threaded so that a coaxial cable plug, mentioned later, may be connected. In this figure, 48 designates a rubber sleeve for protecting the terminal 22 while 49 is a grease applied to the inner surface of the rubber sleeve.

In the above conventional terminal structure shown in FIGS. 2A and 2B, when a plurality of output terminals are attached to the converter body, the hermetically sealing O-ring must be fitted into each of the output terminals and then the output terminals should be secured with a pair of screws. Therefore, this structure requires much time and labor in assembling, resulting in an increased cost. Further, each output terminal must be assembled by squeezing the assembly part into the metallic shell. This structure limits the improvement of the manufacturing efficiency.

In the conventional configuration shown in FIGS. 4A and 4B, a tapped hole 32 should be formed for each output terminal in the converter body. Accordingly, the augment of the number of the output terminals means the increment of the number of the tapped holes 32 to be machined, so that the increment in the number of the output terminals is directly linked with increase of the cost for the unit.

In the configuration shown in FIGS. 5A and 5B, a male thread must be machined on the outer surface of the shell 22*a* in the front end part of the terminal 22 so that an unillustrated coaxial cable plug may be connected thereto. This process requires a space for allowing a tool for the machining to approach the position. Therefore, the pitch $l_1$ between terminals should be set at 25 mm or more. That is, as the number of terminals increases, for example, two terminals (for two output signals) or four terminals (for four output signals), a considerably greater width is required, thus the structure becomes bulky. Further, in the case of the configuration shown in the FIGS. 5A and 5B, the inner-terminal assembly part 22*b* must be inserted from the outside of the shell 22*a* because of limitation of the die-structure for the converter body 21. Therefore, it is necessary to provide a press-ring 47 for preventing the assembly part 22*b* from dropping. This sharply increases the cost.

If the assembly part 22*b* is fixed by only squeezing without using the press-ring 47, the assembly part 22*b* may drop off with the passage of time because it is impossible to establish reliable resistance to temperature variation.

The terminal shells 22*a* need corrosion resistance for a prolonged period of time. Accordingly, if the shells 22*a* is integrally formed with the converter body 21 and made of an aluminum die-casting alloy, the metal coating is very costly. Therefore, a chemical conversion treatment such as phosphating or chromating is done to improve the corrosion resistance. The treatment of the chemical conversion alone, however, cannot maintain its effect for a long time. That is, practical use for two or three years could cause the terminal shells 22*a* to crack. Alternatively, the shell 22*a* may be broken by the external force which is generated when the coaxial cable is swayed as wind blows.

For this reason, the rubbers sleeve 48 with grease 49 is provided to secure a long-term reliability, but this results in increase in cost. Alternatively, there is a method that the converter body 1 made of a zinc die-cast alloy is partially or wholly plated with nickel. This configuration, however becomes very heavy and requires much cost for nickel plating, resulting in unprofitableness.

SUMMARY OF THE INVENTION

It is therefore an object of the present invention to provide an universal LNB converter and a terminal structure to be used for various appliances having a plurality of terminals such as receiver-side converters inclusive of universal LNB converters wherein a plurality of output terminals are composed of low-priced components, can be assembled at low cost in high productivity and is suitable to mass-production.

It is another object of the invention to provide a universal LNB which can be made compact, light and low-priced by narrowing the pitch between its terminals.

It is still another object of the invention to provide an economical receiver-side converter of multiple terminal type such as a universal LNB in which variation of the output voltage standing-wave ratio (VSWR) is suppressed by preventing degradation of its high-frequency characteristic due to the fluctuation of earth-potential levels in the high-frequency band range between distant terminals from each other.

The present invention has been achieved to attain the above object and the gist of the invention is as follows:

A terminal structure of the invention includes: a terminal joint module having a plurality of cylindrical outer conductors each having a core conductor inside the cylinder and a plate-like attachment base on which the cylindrical outer conductors are put together, is constructed such that the outer conductors and the attachment base are integrally formed of an identical material.

Another terminal structure of the invention includes: a terminal joint module having a plurality of cylindrical, metal-made outer conductors each having a core conductor inside the cylinder and a plate-like, resin-made attachment base on which the cylindrical outer conductors are put together, and is constructed such that the outer conductors are integrally formed with the attachment base by the insert-forming process.

In the above cases, the terminal joint module with a desired number of outer conductors may be formed by cutting a terminal strip comprising continuously connected outer conductors, into a section having the required number of outer conductors.

Further, in the above cases, the core conductors are integrally formed with a resin-made strip of continuously connected inner parts so that each of the inner part with the core conductor may be inserted and fixed into a corresponding outer conductor of the terminal joint module.

A universal low noise blockdown converter of the invention includes: a terminal joint module having a plurality of cylindrical outer conductors each having a core conductor inside the cylinder and a plate-like attachment base on which the cylindrical outer conductors are put together, and is constructed such that the outer conductors and the attachment base are integrally formed of an identical material and the attachment base is fixed to one end face of the converter body.

Another universal low noise blockdown converter of the invention includes: a terminal joint module having a plurality of cylindrical, metal-made outer conductors each having a core conductor inside the cylinder and a plate-like, resin-made attachment base on which the cylindrical outer conductors are put together, and is constructed such that the outer conductors are integrally formed with the attachment base by the insert-forming process and the attachment base is fixed to one end face of the converter body.

In the above cases, the terminal joint module with a desired number of outer conductors may be formed by cutting a terminal strip comprising continuously connected outer conductors, into a section having the required number of outer conductors.

In the above cases, the core conductors are integrally formed with a resin-formed strip of continuously connected inner parts so that each of the inner part with the core conductor may be inserted and fixed into a corresponding outer conductor of the terminal joint module.

Further, in the above cases, a common packing or sealing agent may be provided between the attachment base and the converter body so as to hermetically keep the outer conductors formed together on the attachment base.

A universal low noise blockdown converter of the invention includes: a terminal joint module having a plurality of cylindrical, metal-made outer conductors each having a core conductor inside the cylinder and a flat metal-plate attachment base in which the cylindrical outer conductors are provided together through corresponding via-holes, wherein rear ends of the outer conductors projected from the via holes toward the converter inside are press-fitted so that the outer conductors are integrally formed with the attachment base and the attachment base is affixed on the inner side of the converter body so that the outer conductors are projected outside; a single projected wall formed on the outside surface of the converter body so as to enclose projected outer conductors constituting a plurality of output terminals; and a hermetically sealing agent filled inside the projected wall.

In any of the above universal low noise blockdown converter, a plurality of the outer conductors may be arranged zigzag on the attachment base.

In accordance with the invention, since a plurality of output terminals each consisting of an inner conductor and an outer conductor are provided on the common attachment base, only the fixture of the single base attachment to the converter body enables attachment of a multiple number of output terminals at the same time. Further, this structure is able to suppress degradation of the high-frequency characteristic caused by variation of the earth-potential level due to the fluctuation of fixing torque of screws as well as due to the difference of terminal-to-terminal distances.

The outer conductors and the base attachment can be integrally formed while a multiple number of output terminals can be obtained by cutting the terminal strip comprising many outer conductors continuously connected by means of the base attachment strip. By producing a continuously connected strip of inner parts to be inserted into outer conductors, it is also possible to fit a multiple number of the inner-parts into the outer conductors, all at once.

Further, only the attachment of the single packing for a multiple number of output terminals or only filling of sealing agent into the single site, is able to secure hermetic confinement of the multiple number of the output terminals.

Since the pitch between neighboring output terminals can be made narrower by devising the arrangement of the terminals, it is possible to reduce the universal LNB itself, as a whole, in its size and weight. As a result, it is possible to reduce the cost. This feature lends itself to suppressing degradation of the high-frequency characteristic. Further, since the width of the universal LNB body can be reduced owing to the downsizing of the structure of output terminals, it is possible to reduce the area shaded by the LNB body when the LNB is mounted to the antenna and therefore, it is possible to suppress the gain attenuation, whereby a high-efficiency antenna can be produced.

DESCRIPTION OF THE PREFERRED EMBODIMENTS

Embodiments of the invention will be hereinafter be described with reference to the accompanying drawings.

Figure 6:
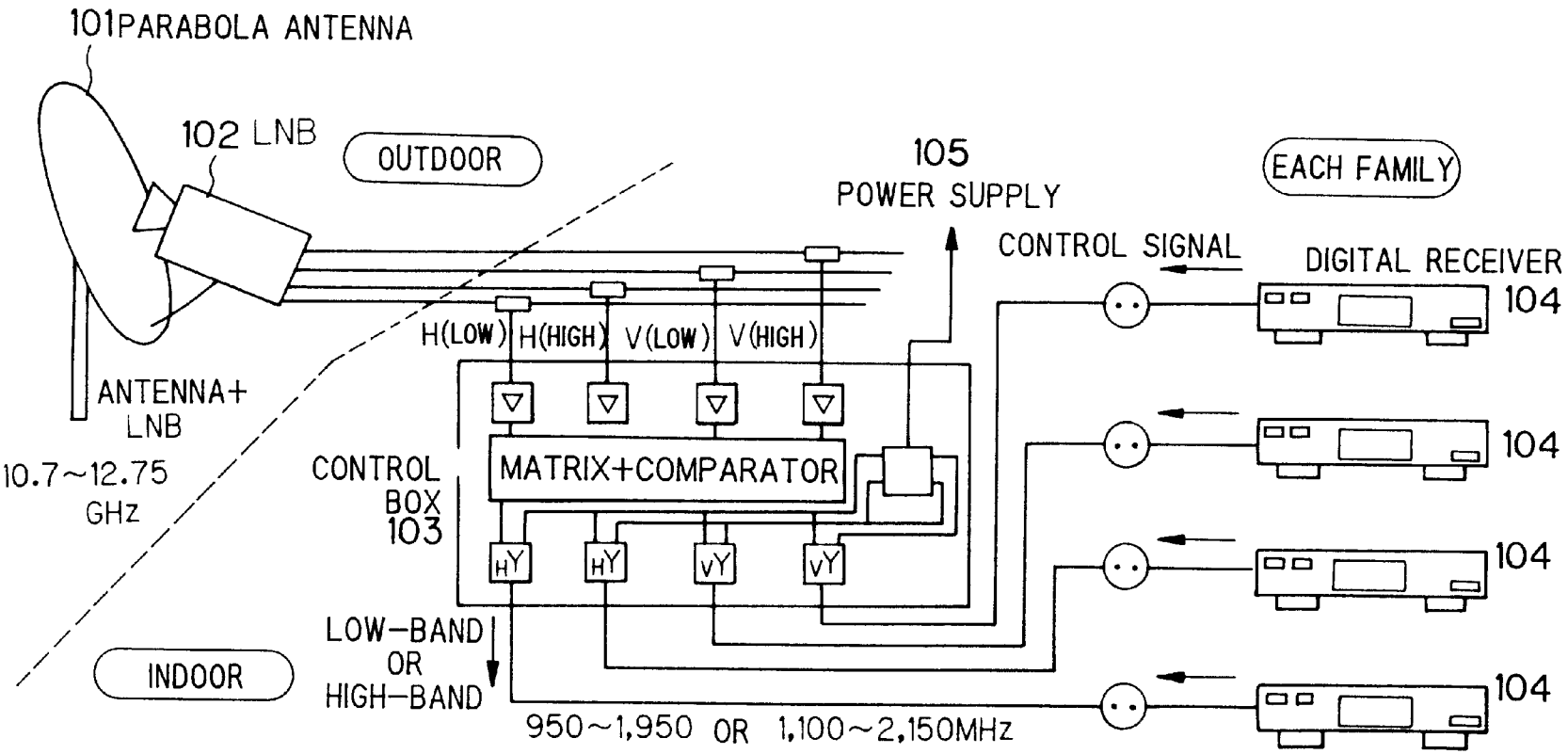
FIG. 6 is a schematic overall view showing an example of a BS-receiver system using a receiver-side LNB converter or the subject feature of the invention.

FIG. 6 is a schematic overall view showing an example of a system using an LNB converter or the subject receiver-side converter of the invention. This figure schematically shows an indirect common receiving system of the satellite master antenna TV (SMATV). In this configuration, a parabola antenna 101 with an LNB converter 102 opposed thereto is placed outside the building. From the converter 102, four terminals for $H_{low}$, $H_{high}$, $V_{low}$ and $V_{high}$, are connected to an indoor control box 103 (containing matrix+comparator) so that the signals are supplied to a multiple number of digital receivers 104 for different families. In this system, switching between low-band and high-band signals is done based on the control signal from each of the digital receivers. In the above, $H_{low}$ means a low-band horizontally polarized wave output signal; $H_{high}$ a high-band horizontally polarized wave output signal; $V_{low}$ a low-band vertically polarized wave output signal; and $V_{high}$ high-band vertically polarized wave output signal. Designated at 105 is a power supply.

Figure 7B:
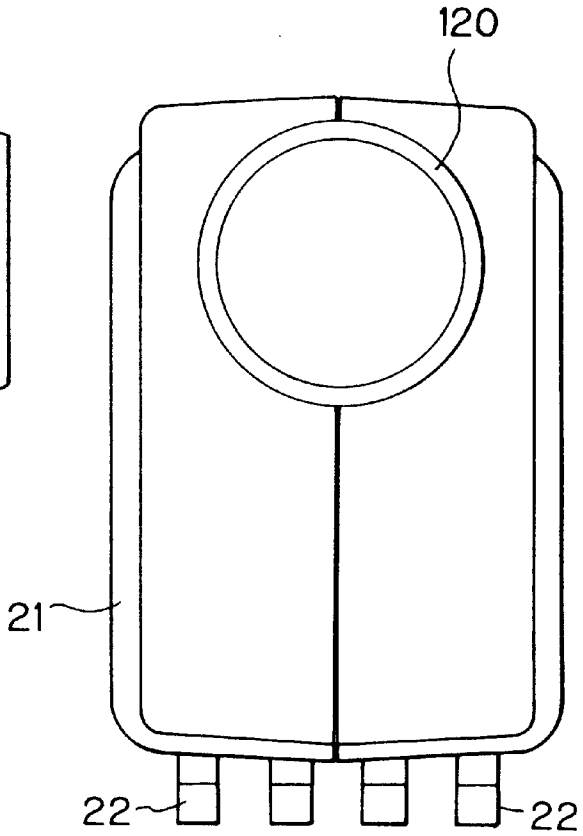
FIG. 7B is a front view showing the appearance of the same receiver-side LNB converter as a target of the invention.
Figure 7A:
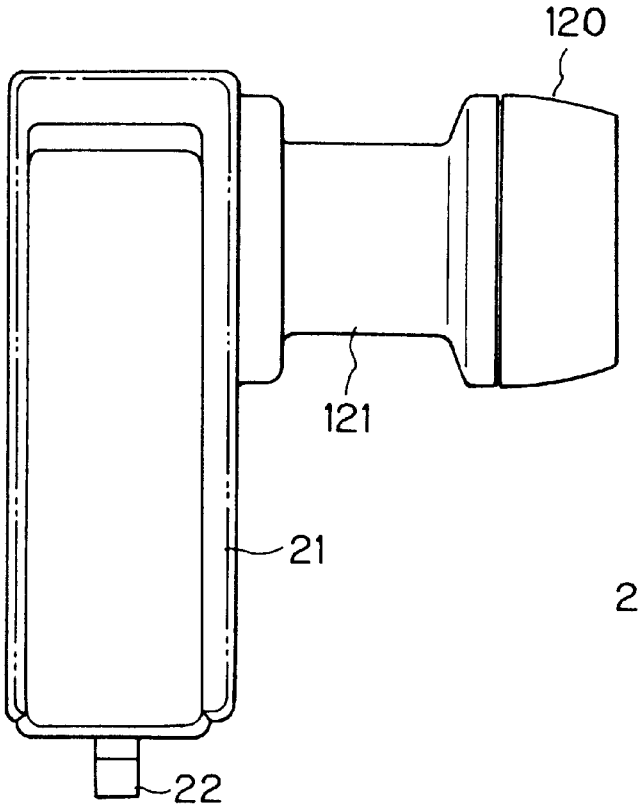
FIG. 7A is a side view showing the appearance of a receiver-side LNB converter as a target of the invention.

FIGS. 7A and 7B show an appearance of the receiving-side LNB converter to be used in the above system. FIG. 7A is a front view and FIG. 7B is a side view of the same. This configuration is an example of an LNB converter of four-output type and generally is composed of a converter body 21 having a waveguide 121 with a feed horn 120 at the end thereof and a plurality of terminals 22 at the bottom thereof.

Figure 1:
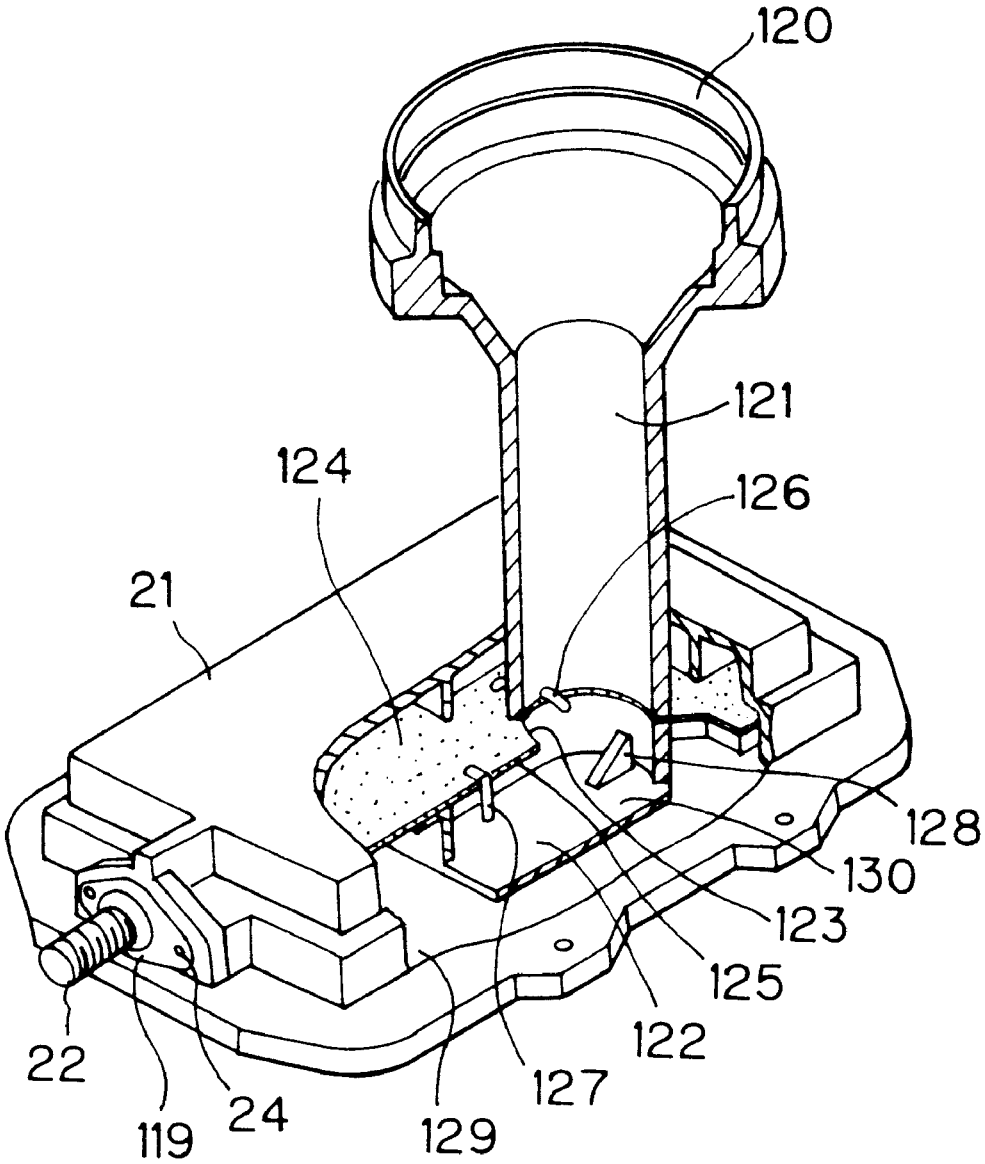
FIG. 1 PRIOR ART
FIG. 1 is a partially cutaway perspective view showing a conventional example of a receiver-side LNB converter.
Figure 8:
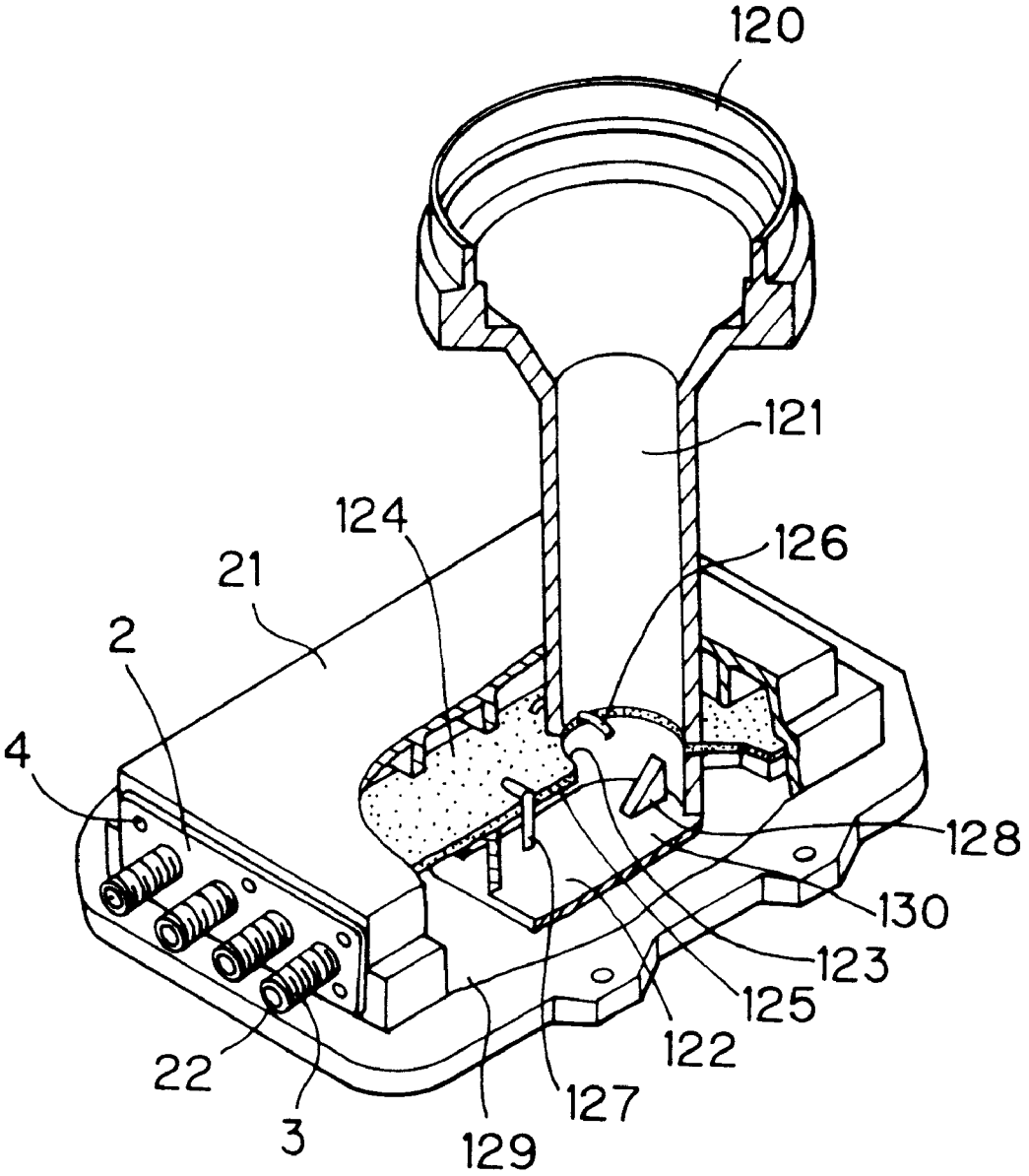
FIG. 8 is a partially cutaway perspective view showing the receiver-side LNB converter shown in FIGS. 7A and 7B.

FIG. 8 is a partially cutaway perspective view of the LNB converter shown in FIGS. 7A and 7B. The configuration shown in FIG. 8 is almost the same with that of the conventional LNB converter previously shown in FIG. 1, except in the configuration around the terminals. Therefore, the same components are allotted with the same reference numerals and the operations of the corresponding components are generally the same, so that the description will not be repeated for those components.

In the configuration of the invention, as seen in FIG. 8, a plurality of terminals 22 each having a shell 3 are placed together on an attachment base 2, which in turn is fixed to the converter body 21 with screws 4.

The receiver-side LNB converter 102 in FIG. 6 having the configuration shown in FIG. 8 is placed at the focus of the hollow parabolic surface of an parabolic antenna 101. In this arrangement, when waves containing horizontally and vertically polarized components are conducted to the circular waveguide 121 through the horn (primary radiator) 120, the vertical polarized wave component is reflected by the matching reflection rib 128 and detected by the second probe 127. The horizontally polarized wave component is reflected by the short-circuited end surface 130 on which the matching reflection rib 128 is formed and is detected by the first probe 126. The thus detected two kinds of polarized wave components, passing through the microstrip circuit board 124, are outputted as signals from the terminals 22 having shells 3 serving as outer conductors, through the aforementioned unillustrated coaxial cables to the next step.

Figure 9A:
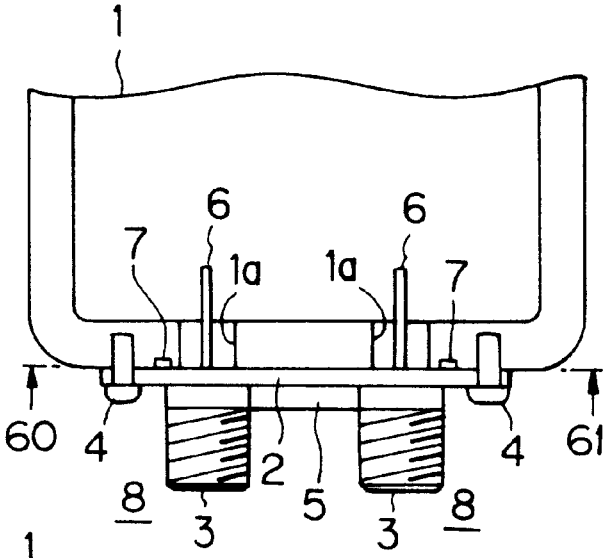
FIG. 9A is a partial sectional-side view showing a first embodiment of the invention.
Figure 9B:
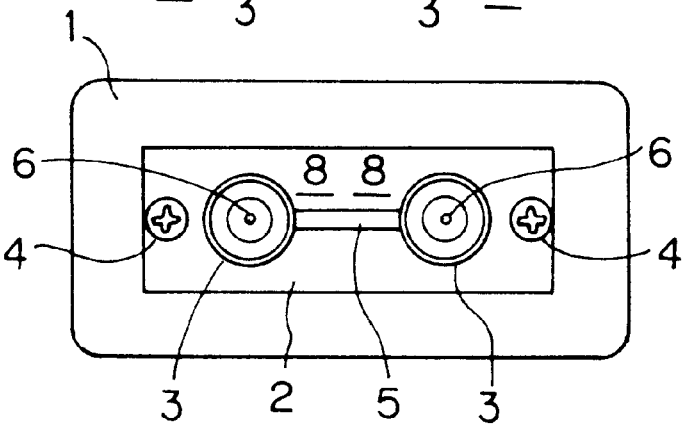
FIG. 9B is a bottom view showing the first embodiment of the invention.
Figure 9C:
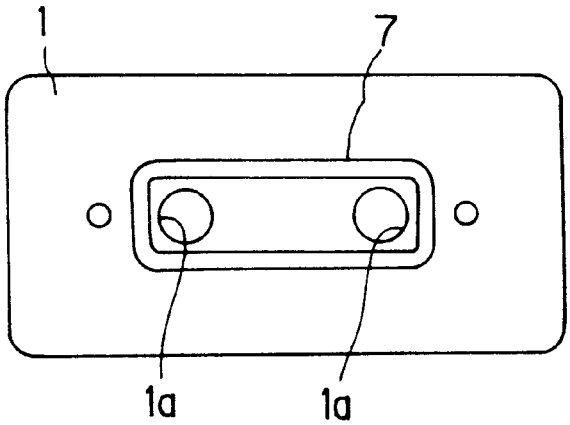
FIG. 9C is a sectional view taken on a line 60-61 in FIG. 9A.

Next, FIGS. 9A through 9C show a first embodiment of a terminal structure of the receiver-side converter of the invention. FIG. 9A is a partial sectional-side view, FIG. 9B is a bottom view and FIG. 9C is a sectional view taken on a line 60-61 in FIG. 9A.

In the terminal structure of this embodiment, a terminal joint module is composed of a plate-like attachment base 2 and a plurality of cylindrical shells (outer conductors) 3 placed together on the attachment base 2, and is fixed to the outer side of the converter body 1 with screws 4 in both ends thereof. The attachment base 2 and shells 3 are formed of the same material by the die-cast process. A rib 5 is provided between neighboring shells 3 in order to improve molding performance.

Shells 3 are formed by the roll-forming process using a metal die or by other methods. It is advantageous that the metal die to be used in this case has a thread formed on the inner side thereof. By this configuration, it is possible to form a male thread on the outer peripheral side of the shell 3 when it is formed. A metal contact 6 as a core conductor is inserted at the center of the shell 3. A plurality of terminal holes la are formed for corresponding metal contacts 6 while a packing 7 is fitted on the outside surface of the converter body 1 so as to enclose all the terminal holes la. Thus, each output terminal 8 is constituted by the combination of the shell 3 and the metal contact 6.

Figure 10A:
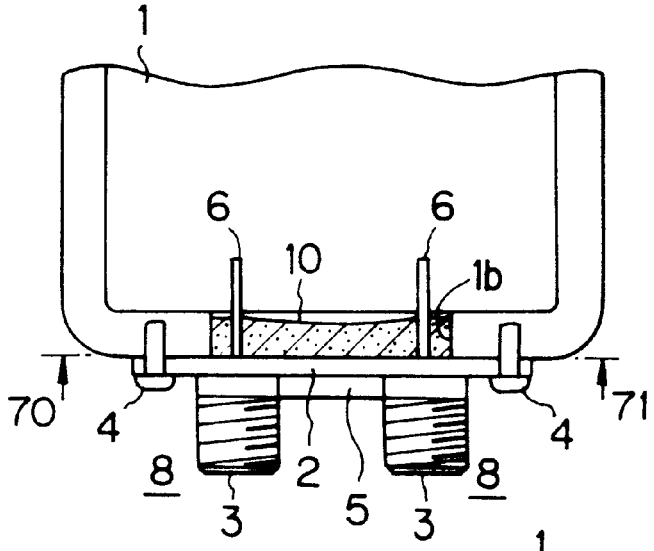
FIG. 10A is a partial sectional-side view showing a second embodiment of the invention.
Figure 10B:
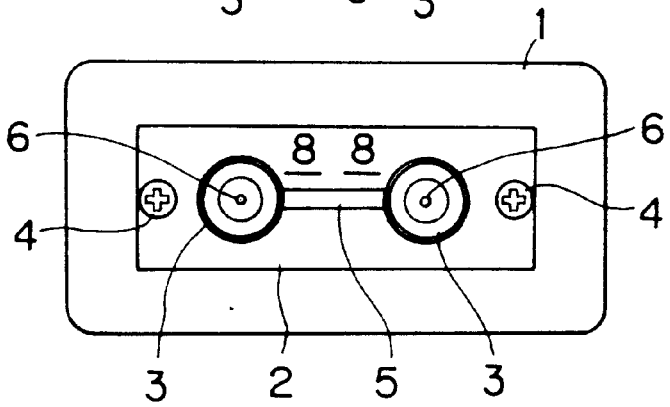
FIG. 10B is a bottom view showing the second embodiment of the invention.
Figure 10C:
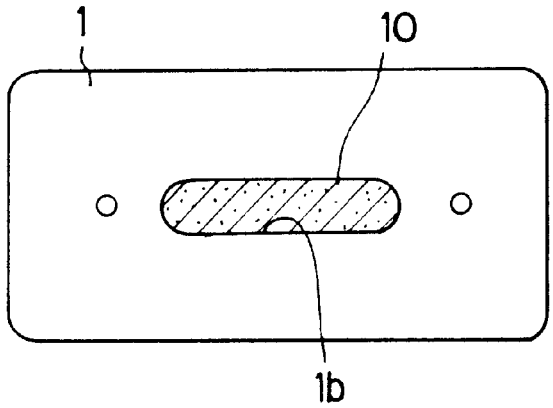
FIG. 10C is a sectional view taken on a line 70-71 in FIG. 10A.

Next, FIGS. 10A through 10C show a second embodiment of a terminal structure of the receiver-side converter of the invention. FIG. 10A is a partial sectional-side view, FIG. 10B is a bottom view and FIG. 10C is a sectional view taken on a line 70-71 in FIG. 10A.

In the terminal structure of the second embodiment, similarly to the first embodiment, a terminal joint module is composed of a plate-like attachment base 2 and a plurality of cylindrical shells 3 placed together on the attachment base 2, and is fixed to the outer side of the converter body 1 with screws 4 in both ends thereof. In this embodiment, however, a single, common terminal hole 1*b* for all the metal contacts 6 is formed in the converter body 1 while a hermetically sealing agent 10 is filled in the terminal hole 1*b*, so that hermetic confinement can be established. Therefore, this configuration does not need any packing 7 as used in the first embodiment.

Figure 11A:
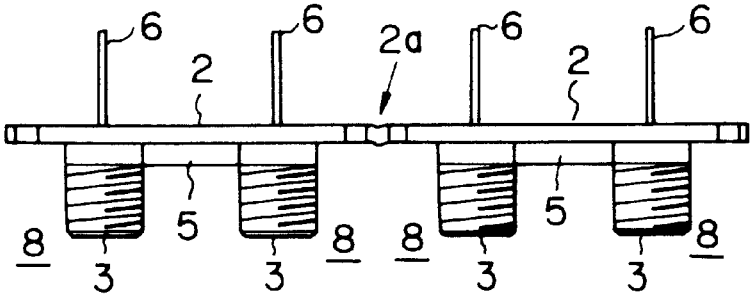
FIG. 11A is a partial sectional-side view showing a connected terminal strip of output terminals shown in FIG. 9A or FIG. 10A.
Figure 11B:
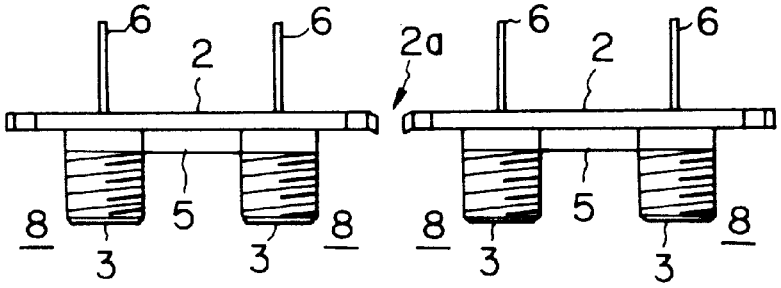
FIG. 11B is a partial sectional-side view showing a process in which the connected terminal strip shown in FIG. 11A is cut into terminal joint modules.

FIGS. 11A and 11B show a process of producing terminal joint modules. Specifically, FIG. 11A shows connected terminal strip in which many (four, in this example) shells 3 are provided together on the united attachment base 2 while FIG. 11B shows a step in which the united attachment base 2 is cut into sections at cutting positions by a press-machine or the like so that a terminal joint module having a required number of shells 3 or output terminals 8, for example, two, three or four terminals, may be obtained. Accordingly, it is no more necessary to separately produce a dedicated metal die for two output terminals, three output terminals or four output terminals, unlike in the conventional method. Therefore, this method is convenient and markedly economical.

Figure 12A:
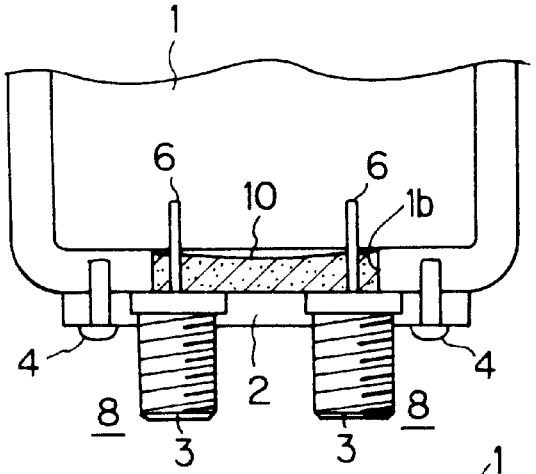
FIG. 12A is a partial sectional-side view showing a third embodiment of the invention.
Figure 12B:
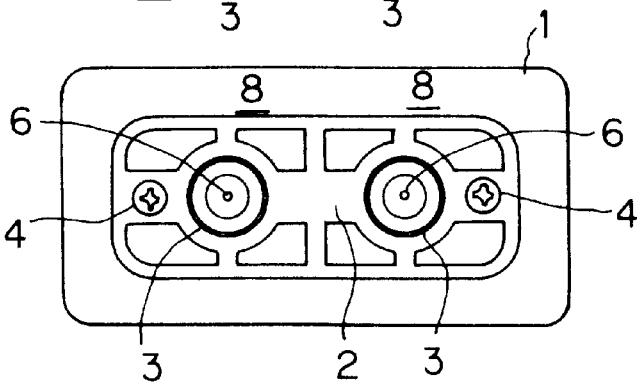
FIG. 12B is a bottom view showing the third embodiment of the invention.

Next, FIGS. 12A and 12B show a third embodiment of a terminal structure of the receiver-side converter of the invention. FIG. 12A is a partial sectional-side view and FIG. 12B is a bottom view. In the terminal structure of this embodiment, the attachment base 2 is formed of a plastic molding. Metallic shells 3 (with male thread on the outer peripheral side) formed by machining, roll-forming or other processes are inserted when fused plastic is molded to a die, whereby the fused plastic flows around the shells 3 and is cured as it is cooled to form an integral structure of the attachment base 2 with the shells 3 fixed. The other arrangement is the same with the previous arrangement shown in FIGS. 10A through 10C, except that there is no rib 5 in this structure.

Figure 13A:
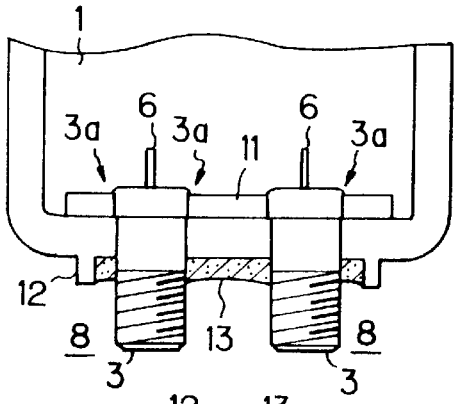
FIG. 13A is a partial sectional-side view showing a fourth embodiment of the invention.
Figure 13B:
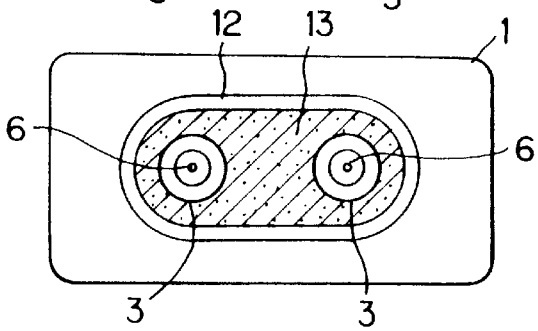
FIG. 13B is a bottom view showing the fourth embodiment of the invention.

FIGS. 13A and 13B show a fourth embodiment of a terminal structure of the receiver-side converter of the invention. FIG. 13A is a partial sectional-side view and FIG. 13B is a bottom view. In the terminal structure of this embodiment, metallic shells 3 formed by machining, roll-forming or other processes are placed so that the shells 3 are penetrated through the wall of the converter body 1 and a metal plate part 11 affixed on the inner side of the converter body 1, and the rear ends 3a of the shells 3 projected from the backside of the metal plate part 11 are partially pressed and crushed by a press-machine or the like to form press-fixing. Further, a low cylindrical wall 12 projected from the outer surface of the converter body 1 is provided so as to enclose the multiple number of output terminals 8, while a hermetically sealing agent 13 is filled inside the cylindrical wall 12 to thereby establish hermetic confinement.

Figure 14A:
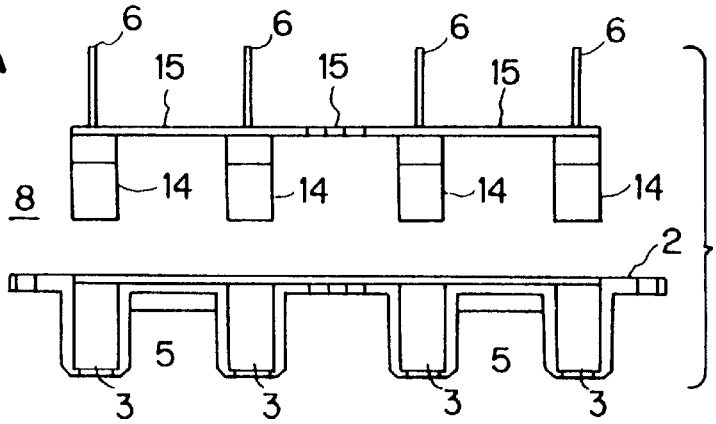
FIG. 14A is a partial sectional-side view showing another configuration of output terminals; third embodiment of the invention.
Figure 14B:
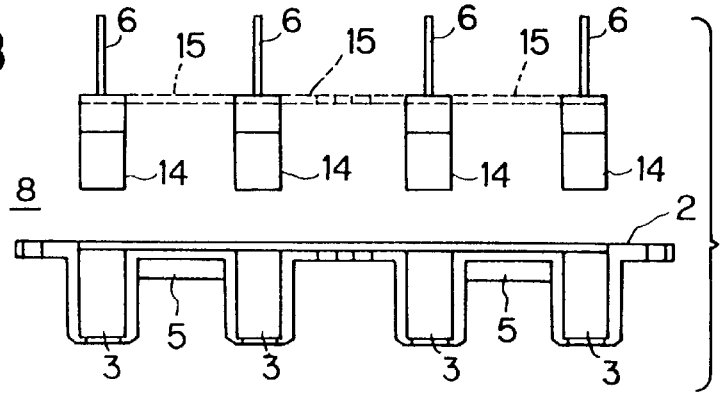
FIG. 14B is a partial sectional-side view showing how the output terminals shown in FIG. 14A are assembled.

FIGS. 14A and 14B show an embodiment in which inner parts 14 constituting output terminals 8 are formed by resin molding. When formed, inner parts 14 are integrally molded with connecting members 15 to form a blocked series of inner parts 14. The thus formed blocked series of several inner parts is inserted together, as shown in FIG. 14A, into a continuous series of terminal joint modules each composed of an attachment base 2 and shells 3. In this operation, when blocked inner parts 14 are inserted into the shells 3, connecting members 15 between inner parts 14 are punched away while the inner parts 14 are assembled in place by press-fitting (see FIG. 14B).

Figure 5A:
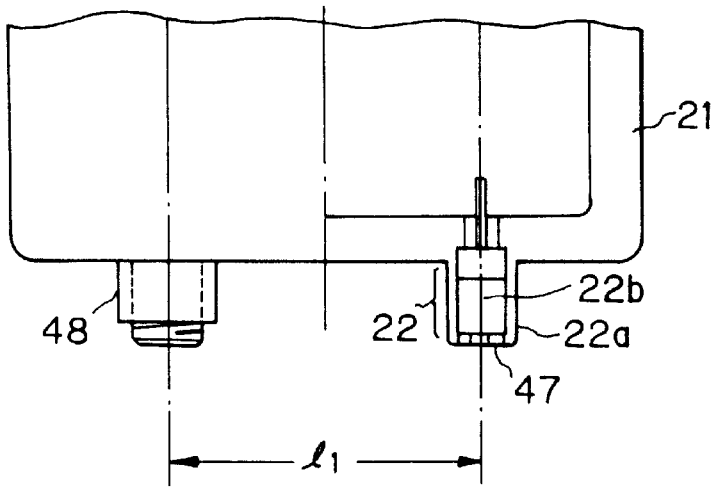
FIG. 5A PRIOR ART
FIG. 5A is an assembled view showing an example of a conventional converter in which terminals shells are integrally formed with a converter body.
Figure 5B:
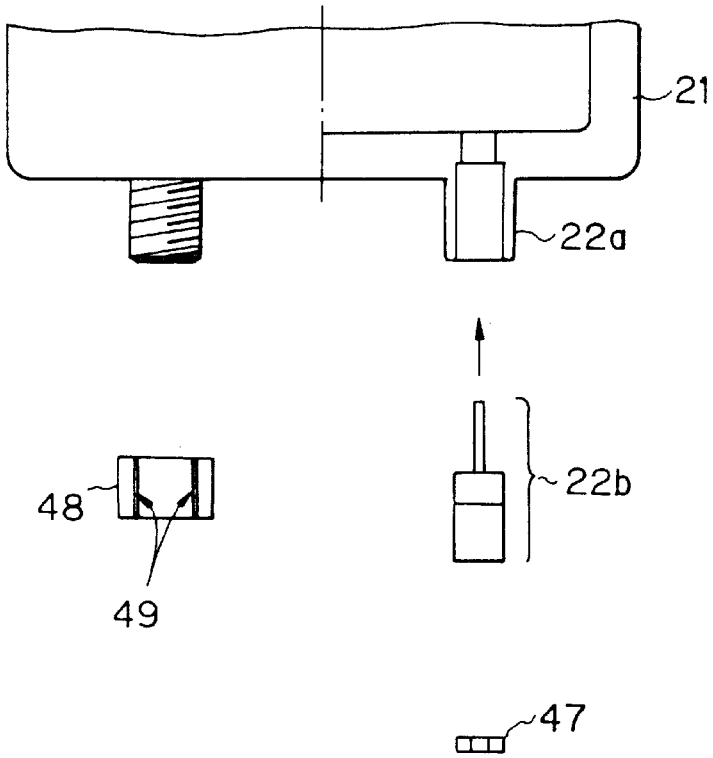
FIG. 5B PRIOR ART
FIG. 5B is a decomposed view showing the same example of the conventional converter in which terminals shells are integrally formed with a converter body.
Figure 15:
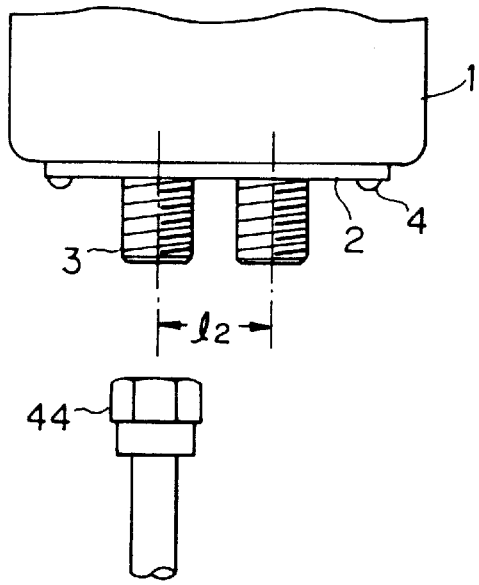
FIG. 15 is a side view showing a fifth embodiment of the invention.

FIG. 15 shows a terminal structure of a fifth embodiment of the invention. This embodiment is an improved configuration of the conventional example previously described in FIGS. 5A and 5B. Specifically, as stated in the prior art example of FIGS. 5A and 5B, in the terminal structure in FIGS. 5A and SB, the pitch $l_1$ between neighboring terminals need be 25 mm or more in order that a male thread for allowing connection with a coaxial cable may be machined on each of the terminal shells. The embodiment of the invention shown in FIG. 15 is improved in this respect. That is, in place of the method of forming a male thread on the outside peripheral side of shells after the shells are put together with the converter body, the attachment base 2 with male-threaded shells 3 integrated thereto is secured to the converter body 1 with screws 4.

In this case, the center distance $l_2$ between neighboring shells 3 may be adequate as long as the coaxial cable plugs 44 can be easily fitted in and out without obstruction. As an example, in the conventional method of FIGS. 5A and 5B, the center distance between neighboring shells needs at least 25 mm as stated above, while in the method of the invention shown in FIG. 15, the pitch $l_2$ of 15 mm or more is enough to allow the same coaxial cable plugs to be fitted in without any obstruction. This feature by which the center distance between neighboring shells 3 or terminal-to-terminal dimension can be shortened, directly makes the receiver-side converter compact and light as a whole. Specifically, when the converter body and the terminal portion are integrally die-casted by zinc die-casting alloys and plating the surface of it with nickel to produce a conventional type receiving-side converter shown in FIGS. 5A and 5B, the weight of the converter becomes as much as about 650 g and its width becomes large too.

When the converter having the same functions is formed by the method of the invention shown in FIG. 15, the weight can be markedly decreased to as light as about 300 g and the device can be made compact. Further, in the method of FIG. 15, unillustrated inner-parts or assembly parts (corresponding to the assembly part 22*b* in FIGS. 5A and 5B) can be pushed into the shells 3 from the upper side before the attachment base 2 with shells 3 is fixed to the converter body with screws 4. Therefore, there is no need to take dropping of assembly parts 22*b* into account, unlike the conventional example of FIGS. 5A and 5B. Also to satisfy the requirement of the resistance to corrosion, it is possible to form the shells 3 and the base attachment 2 alone with zinc die-casting alloys and plate the resultant article with nickel while the converter body can be formed of, for example, a synthetic resin. In this configuration, it is possible to make the device markedly light and inexpensive as compared to the conventional configuration and still it is possible to produce a highly reliable product.

Figure 16A:
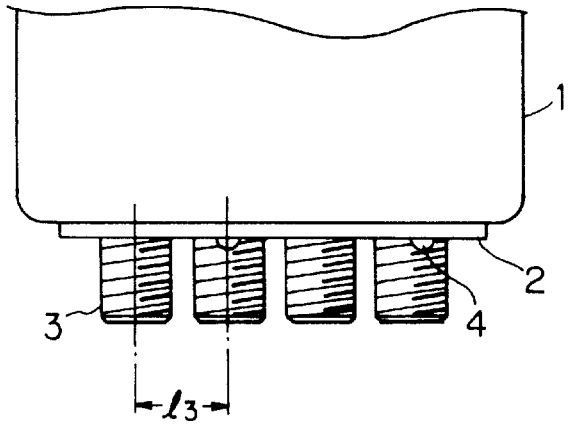
FIG. 16A is a side view showing a sixth embodiment of the invention.
Figure 16B:
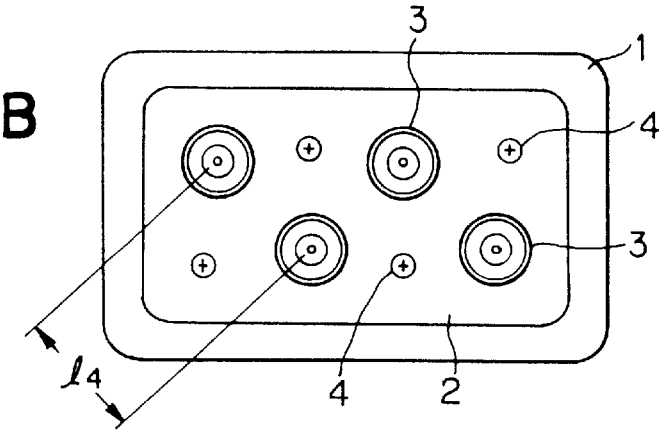
FIG. 16B is a bottom view showing the sixth embodiment of the invention.

In the present invention, a further down-sizing can be done by adopting a terminal arrangement shown in FIGS. 16A and 16B.

FIGS. 16A and 16B show a sixth embodiment of a terminal structure of the receiver-side LNB converter of the invention. FIG. 16A is a partial sectional-side view and FIG. 16B is a bottom view. As seen in the figures, terminals shells 3 are disposed zigzag on an attachment base 2, which in turn is fixed to the converter body 1 with screws 4. In this case, as stated above, coaxial cable plugs will not interfere with each other when they are fitted in or out as long as the center distance or terminal-to-terminal pitch 14 between neighboring shells is 15 mm or more. Therefore, if a terminal-to-terminal pitch 13 viewed from the side (see FIG. 16A) is set at 10.6 mm or more, this arrangement is able to satisfy the above requirement.

As seen in FIG. 16B, this configuration of the converter has a greater thickness, but the width can be reduced to a certain extent by virtue of the zigzag arrangement of terminals. That is, this configuration is able to suppress its gain attenuation due to the shadow of the converter when the receiver-side LNB converter is mounted in the parabolic antenna (dish). Accordingly, a high-efficiency antenna can be expectedly obtained.

Now, validity of the invention to the fluctuation of the output voltage standing-wave ratios (VSWR) in a multiple terminal type converter will be described using a seventh embodiment of a terminal structure shown in FIG. 17 and a comparative example shown in FIG. 18.

Figure 2A:
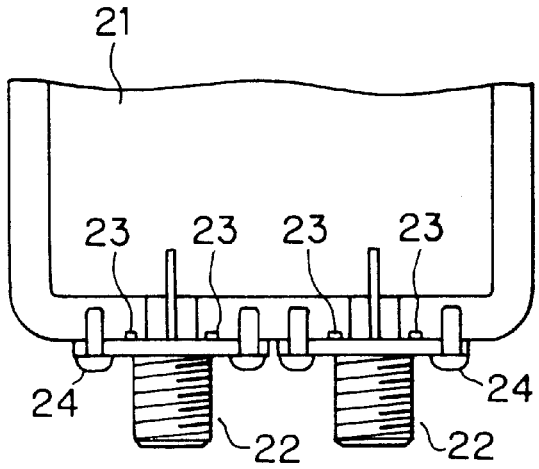
FIG. 2A PRIOR ART
FIG. 2A is a partial sectional view showing a conventional LNB converter.
Figure 2B:
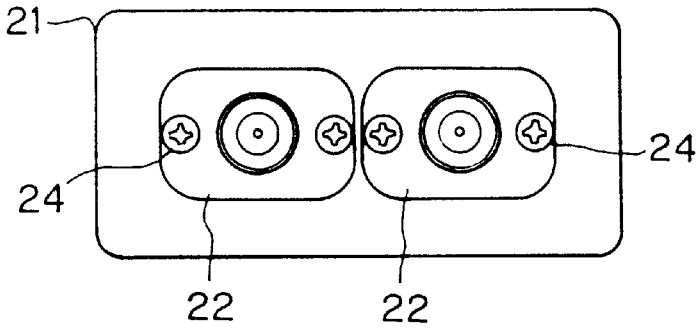
FIG. 2B PRIOR ART
FIG. 2B is a bottom view showing the same conventional LNB converter.
Figure 3:
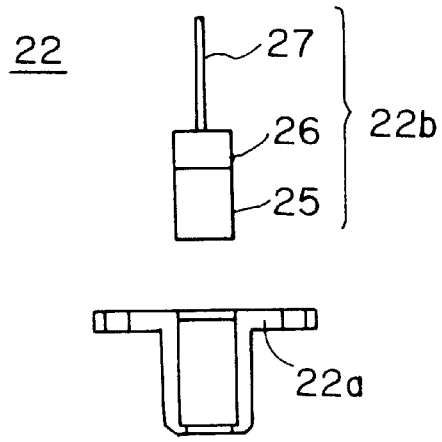
FIG. 3 PRIOR ART
FIG. 3 is a sectional view illustrating the structure of an output terminal shown in FIGS. 2A and 2B.
Figure 4A:
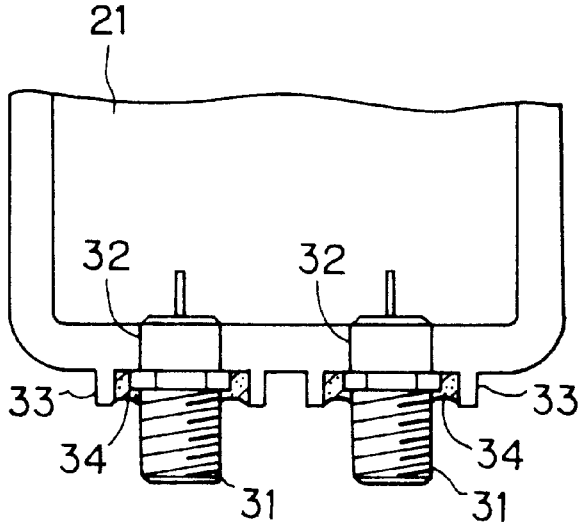
FIG. 4A PRIOR ART
FIG. 4A is a partial sectional view showing another conventional LNB converter.
Figure 4B:
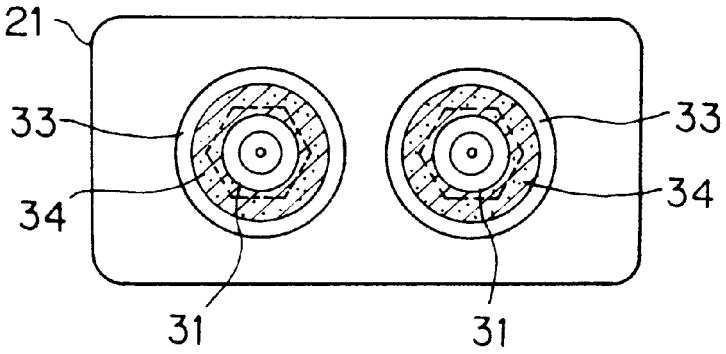
FIG. 4B PRIOR ART
FIG. 4B is a bottom view showing the same conventional LNB converter.
Figure 18:
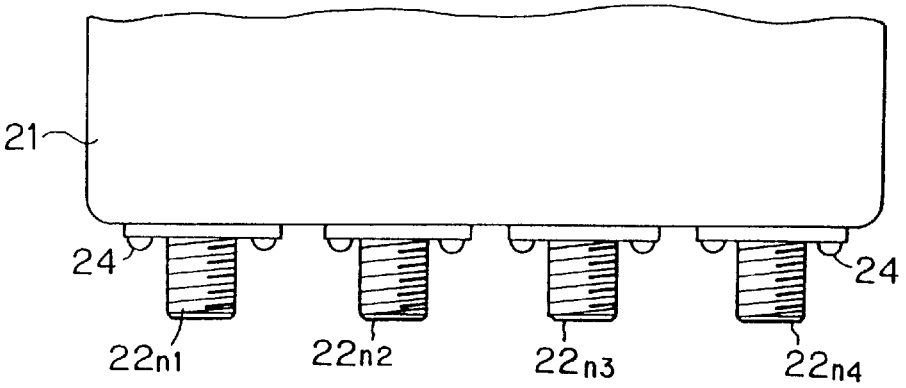
PRIOR ART FIG.18
FIG. 18 is a side view showing a comparative example showing a multiple terminal type structure.

FIG. 18 is a side view showing a comparative example of a multiple terminal type converter. This configuration is basically the same with that shown in the side view of FIG. 2A, except in that an increased number of terminals are provided in its width direction. In this case, output terminals $\mathbf{22}n_1$ through $\mathbf{22}n_4$ are separately secured to the converter body 21 with screws 24. In this configuration, earth-potential levels for terminals $\mathbf{22}n_1$ and $\mathbf{22}n_4$ differ in the order of some tens milli-volts. This difference is attributed to variations of the contact resistance of the terminals $\mathbf{22}n_1$ and $\mathbf{22}n_4$ with the converter body 21 and the positional difference of the terminals. That is, the earth potential is influenced by the fluctuation of the surface treatment of parts, the fluctuation of fixing torque of screws 24 and other factors. For this reason the output voltage standing-wave ratio (VSWR) becomes greater toward the high-frequency band range. That is, as indicated by a curve B for the comparative example shown in FIG. 19 (to be detailed layer), some terminals may appear to present a considerably bad characteristic of the output voltage standing-wave ratio (VSWR) in the conventional configuration.

Figure 17A:
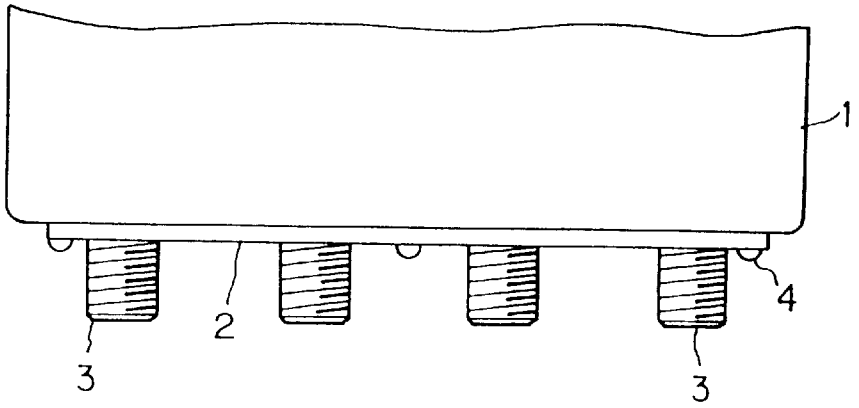
FIG. 17A is a side view showing a seventh embodiment of the invention.
Figure 17B:
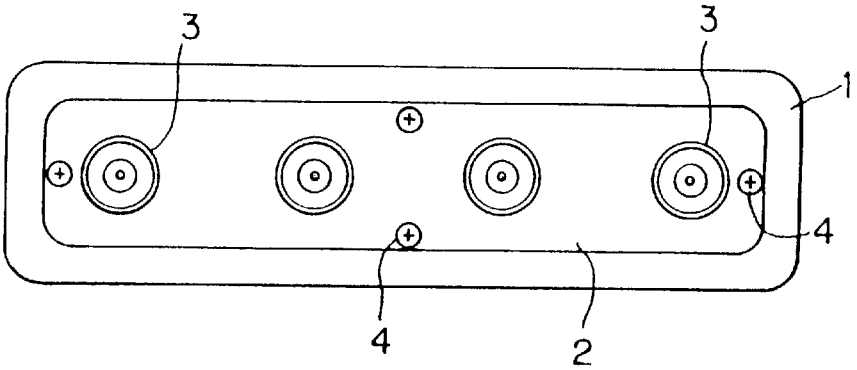
FIG. 17B is a bottom view showing the seventh embodiment of the invention.

FIG. 17A and FIG. 17B are side and bottom views of an embodiment of the invention, respectively.

In contrast to the above comparative example, an attachment base 2 with a multiple number of terminal shells 3 is fixed to the converter body 1 with screws 4 to form a multiple terminal structure as seen in FIGS. 17A and 17B. In view of the corrosion resistance, the surfaces of the shells 3 and the attachment base 2 are plated with a metal having good contact performance.

Figure 19:
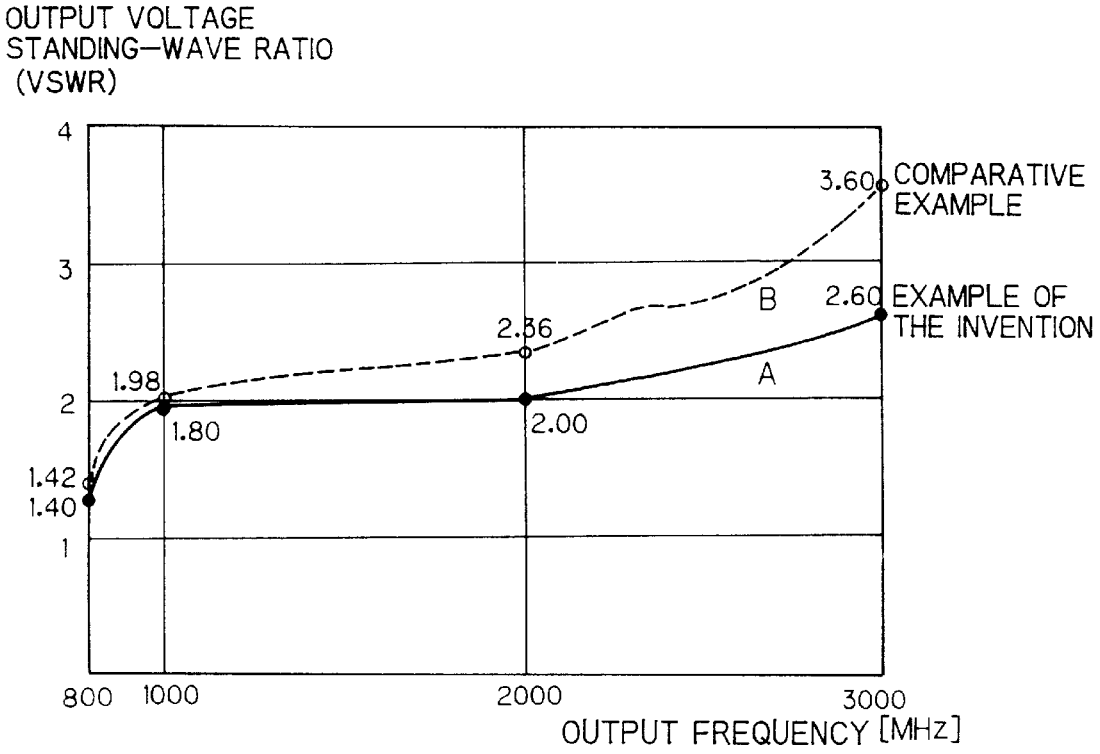
FIG. 19 is a graph depicting relations between the output terminal frequency and the output voltage standing-wave ratio (VSWR).

That is, in the configuration of the invention shown in FIGS. 17A and 17B, unlike the case of the previous comparative example shown in FIG. 18, the terminal shells 3 are put together on the attachment base 2, which in turn is affixed to the converter body 1 with screws. Accordingly, there is no possibility that the output voltage standing-wave ratio (VSWR) in this configuration is affected by the difference of the fixing torque of screws 4, the fluctuation of contact resistance and the fluctuation due to distances between terminals. Therefore all the terminal shells 3 present the same earth-potential level regardless of the positions of individual terminal shells. In other words, it is possible to suppress the variations of the output voltage standing-wave ratio (VSWR) to a minimum extent. FIG. 19 is a graph showing the above comparison. Specifically, the graph depicts relations between the output frequency and the output voltage standing-wave ratio (VSWR) for the terminal structure of the comparative example shown in FIG. 18 and for the terminal structure of the invention shown in FIGS. 17A and 17B. In FIG. 19, a curve indicated at A shows the result of the invention and a curve indicated at B shows the result of the comparative example. The relation between the two modes can be summarized in Table 1 below:

TABLE 1

| Output Frequency | Output VSWR | | Transmitted Power (%) | |
|---|---|---|---|---|
| (MHZ) | A | B | A | B |
| 800 | 1.40 | 1.42 | 97.22 | 96.90 |
| 1000 | 1.80 | 1.98 | 91.84 | 89.26 |
| 2000 | 2.00 | 2.36 | 88.89 | 83.80 |
| 3000 | 2.60 | 3.60 | 80.25 | 68.05 |

[note]
(1) A: Example of the Invention
B: Comparative Example
(2) When the output VSWR is 1.00, the transmitted power is 100(%).

[note]
(1) A: Example of the Invention
B: Comparative Example
(2) When the output VSWR is 1.00, the transmitted power is 100(%).

As is apparent from FIG. 19 as well as Table 1, the output VSWR in the configuration of the invention differs from that in the comparative example, especially in the high-frequency band range. Specifically, the output VSWR of the comparative example at 3000 MHz is greater by 1.00 (VSWR) than that of this invention. This means that the reflection loss in the configuration of the invention (shown in FIGS. 17A and 17B) is superior by 2 dB to that of the configuration of the comparative example shown in FIG. 18. This is a remarkably great difference in the viewpoint of energy. As to the transmitted power at 3000 MHz, 80.25% of power can be transmitted by the configuration of the invention, whereas 68.05% of power is transmitted in the comparative example. That is, the signal loses one-third of its input power as transmitted through the terminal structure of FIG. 18 while the signal transmitted through the terminal structure of FIGS. 17A and 17B attenuates by only one-fifth of its input power.

As has been apparent from the above result, since the fluctuation of the output VSWR in the comparative example becomes large in the high-frequency band range, it is not very hard to realize that most of the output terminals present bad output VSWR characteristics in the high-frequency band range. As to the example of the invention, it is apparent that the output voltage standing-wave ratio (VSWR) is kept rather stable even in the high frequency band range. It should be noted that this characteristic of the invention can be applied to not only receiver-side LNB converters but also to the output terminals of a CATV distributor or tap.

In accordance with the invention, the assembling time for fitting the output terminals to the converter body can be shortened. Besides, the operation of attaching hermetically sealing packing as well as the operation of filling sealing agent can be done efficiently. As a result, it is possible to shorten the work time by about 30% as compared to that for the conventional configuration. Since in the manufacture of the output terminals, a blocked series consisting of a multiple number of inner-parts can be assembled all at once, it is possible to improve the production efficiency by 40% or more.

In accordance with the invention, since the central distance between neighboring terminals can be reduced, it is possible to reduce the receiver-side converter in its size, weight and cost.

In accordance with the invention, it is possible to provide an economical universal LNB converter in which fluctuation of the output voltage standing-wave ratio (VSWR) is suppressed by preventing deterioration of the high-frequency characteristic as to the receiver-side converter of multiple terminal type.

What is claimed is:

1. A universal low noise block-down converter, having a body comprising:

a plurality of cylindrical outer conductors, each of said outer conductors having a core conductor inserted therein; and a single flat plate attachment base consisting of a first and second flat surface parallel to each other, the first surface of said base attached to a face of the converter body, so that air tightness is achieved without an "0"ring, said first surface effective to provide easy achievement of air tightness with the converter body, said attachment base supporting said outer conductors, said outer conductors being perpendicular to the attachment base, said outer conductors and said attachment base are integrally formed of an identical material, wherein said core conductors are integrally formed with a resin-formed strip of continuously connected inner parts, and each of said inner parts with said core conductor is inserted and fixed into a corresponding outer conductor.

2. A universal low noise blockdown converter according to claim 1, wherein a desired number of outer conductors is formed by cutting a terminal strip including continuously connected outer conductors, into a section having the required number of outer conductors.

3. A universal low noise blockdown converter according to claim 1, wherein a common packing or sealing agent is provided between said attachment base and said converter body so as to hermetically keep said outer conductors formed together on said attachment base.

4. A universal low noise blockdown converter according to claim 1, wherein a plurality of said outer conductors are arranged in zigzag on said attachment base.

5. An apparatus comprising: a universal low noise block-down converter body with a converter casing having a first opening;

a plurality of cylindrical, metal outer conductors, each of said outer conductors having a core conductor inserted therein and each of said outer conductors having a first end and a second end;

a flat metal-plate attachment base having a plurality of openings through which said outer conductors are inserted, wherein second ends of said outer conductors projected from said attachment base are press-fitted so that said outer conductors are integral with said attachment base, and said attachment base is affixed on an inner side of a converter body so that first ends of said outer conductors are projected outside of said converter body from said first opening, said flat metal-plate attachment base attached to the converter body being effective to provide easy achievement of air tightness with the converter body;

a single projected wall formed on an outside surface of the converter body, said wall surrounding said projected outer conductors; and a hermetically sealing agent filled in an area defined by said projected wall.

6. A universal low noise blockdown converter according to claim 5 wherein a plurality of said outer conductors are arranged zigzag on said attachment base.

* * * * *